US006880272B2

(12) United States Patent
Wells

(10) Patent No.: US 6,880,272 B2
(45) Date of Patent: Apr. 19, 2005

(54) EASY SLIP FIT SHOE

(76) Inventor: Raymond Wells, Via Martiri Della Liberazione 31, 18010 Diano Castello, Imperia (IT)

( * ) Notice: Subject to any disclaimer, the term of this patent is extended or adjusted under 35 U.S.C. 154(b) by 0 days.

(21) Appl. No.: 10/000,027

(22) Filed: Jan. 22, 2002

(65) Prior Publication Data

US 2002/0066213 A1 Jun. 6, 2002

(51) Int. Cl.[7] ..... A43B 11/00
(52) U.S. Cl. ..... 36/138; 36/105
(58) Field of Search ..... 36/138, 105, 69, 36/68, 172 B; 223/118

(56) References Cited

U.S. PATENT DOCUMENTS

| | | | | |
|---|---|---|---|---|
| 1,012,253 A | * | 12/1911 | Gerhart | 36/68 |
| 1,782,620 A | | 11/1930 | Jones | |
| 2,088,976 A | * | 8/1937 | Resnik | 36/138 |
| 2,319,356 A | * | 5/1943 | Sullivan | 36/68 |
| 2,446,777 A | * | 8/1948 | Menenko | 36/138 |
| 3,097,438 A | | 7/1963 | Evans | |
| 3,643,350 A | | 2/1972 | Paoletta et al. | |
| 3,851,412 A | * | 12/1974 | Voegele et al. | 36/72 B |
| 4,503,628 A | * | 3/1985 | Mancinelli et al. | 36/68 |
| 5,842,292 A | * | 12/1998 | Siesel | 36/58.5 |
| 5,901,468 A | * | 5/1999 | Whyte | 36/43 |
| 6,426,132 B1 | * | 7/2002 | Stewart | 223/118 |

FOREIGN PATENT DOCUMENTS

| | | |
|---|---|---|
| CH | 263615 | 12/1949 |
| DE | 100 19 865 | 10/2001 |
| EP | 1 059 044 A1 | 12/2000 |
| GB | 2 090 723 | 8/1982 |
| GB | 2 235 360 | 3/1991 |

* cited by examiner

*Primary Examiner*—Ted Kavanaugh
(74) *Attorney, Agent, or Firm*—Young & Thompson

(57) ABSTRACT

A shoe horn attachment (8) for a shoe has guiding means (2, 2*a*) for guiding the heel of a user's foot as the user inserts the foot into the shoe. At least one fastener (13, 15) is provided for securing the attachment to the shoe.

A user can press on the upper back edge (2*b*) of the attachment when taking the shoe off, and this makes it easier to take the shoe off.

A person who becomes disabled or who otherwise has difficulty in bending down to put on and take off their shoes may fit their shoes with shoe horn attachments of the invention.

12 Claims, 6 Drawing Sheets

EASY SLIP FIT SHOE

FIELD OF THE INVENTION

The present invention relates to a shoe horn attachment for a shoe, in particular, to a shoe horn attachment that may easily be secured to a shoe and that, once fitted, guides the heel of a user as the user inserts a foot into the shoe. Such an attachment makes it easier for a user to put the shoe on, and also prevents damage to the shoe.

BACKGROUND OF THE INVENTION

There are many designs of shoe, but they generally fall into one of two types. A first type of shoe is provided with a fastening means, such as a lace or buckle. A user generally puts such a shoe on with the fastening means undone, and then does up the fastening means to make the shoe a close fit to their feet. The act of doing up the fastener requires the user to bend down, and this may be difficult for, for example, an elderly or disabled person. A lace-up or buckle-up shoe is generally a very loose fit around the user's foot when it is not laced or buckled, so that it is dangerous to walk around with the fastening means not properly fastened.

A user is also required to bend down in order to take off such a shoe, since it is necessary to undo the fastening means before the shoe can be taken off.

Another type of shoe is a "slip-on" shoe, which is not provided with fastening means. To put on a slip-on shoe, a user simply pushes their foot into the shoe, and the upper of the shoe is able to deform to accommodate the user's foot and to grip the user's foot securely.

Slip-on shoes eliminate the need for the user to bend down to do up a lace, buckle or other fastener. However, the user is still required to bend down while putting on the shoe, as it is necessary to guide the heel of the user's foot into the shoe. This may be done by inserting a suitable implement, for example a shoe horn, between the back of the user's heel and the upper of the shoe during the process of putting the shoe on; it may also be done by the user running a finger between the back of the user's heel and the upper of the shoe as the shoe is put on. If this is not done, the act of putting on the shoe tends to crush the back of the upper of the shoe, and doing this repeatedly will damage the shoe.

Shoes are known in which the upper of the shoe is open at the back, so that the upper does not completely surround the user's foot. This footwear may be put on without requiring the user to bend down, but, because the upper does not surround the user's foot, it is possible for the user's foot to move relative to the shoe or even to slip completely out of the shoe. As a result, such footwear is suitable only for very light use.

In many cases an elderly or disabled person will require assistance in order to put their own shoes on or to take their own shoes off. In a hospital, for example, this means that nurses may spend considerable time just in assisting patients to put on or remove shoes.

BRIEF DESCRIPTION OF THE PRIOR ART

UK Patent Application No. 9018750.1 discloses a shoe having an integral shoehorn. The shoe horn is built into the construction of the shoe, and is intended to guide the user's foot as the user puts the shoe on and so prevent damage to the upper of the shoe.

SUMMARY OF THE INVENTION

The present invention provides a shoe horn attachment for a shoe, the shoe horn attachment having guiding means for guiding the heel of a user's foot as the user inserts the foot into the shoe; and means for securing the attachment to the shoe.

A shoe horn attachment of the present invention may be fitted to any existing shoe. Once this has been done a user can put the shoe on without needing to bend down, since the shoe horn attachment will guide the user's foot into the shoe. The user may also remove the shoe without needing to bend down. Furthermore, use of the shoe horn attachment prevents the back of the upper of the shoe from being distorted when the shoe is put on, and so prevents damage to the shoe.

If a person should become disabled they may fit a shoe horn attachment of the invention to each of their existing shoes, and thereby avoid the need to buy special shoes of the type disclosed in UK Patent Application No. 9018750.1.

BRIEF DESCRIPTION OF THE DRAWINGS

Preferred embodiments of the present invention will now be described way of illustrative example with reference to the accompanying figures in which.

Like reference numerals denote like components throughout the drawings.

DETAILED DESCRIPTION OF PREFERRED EMBODIMENTS

Figure 1:
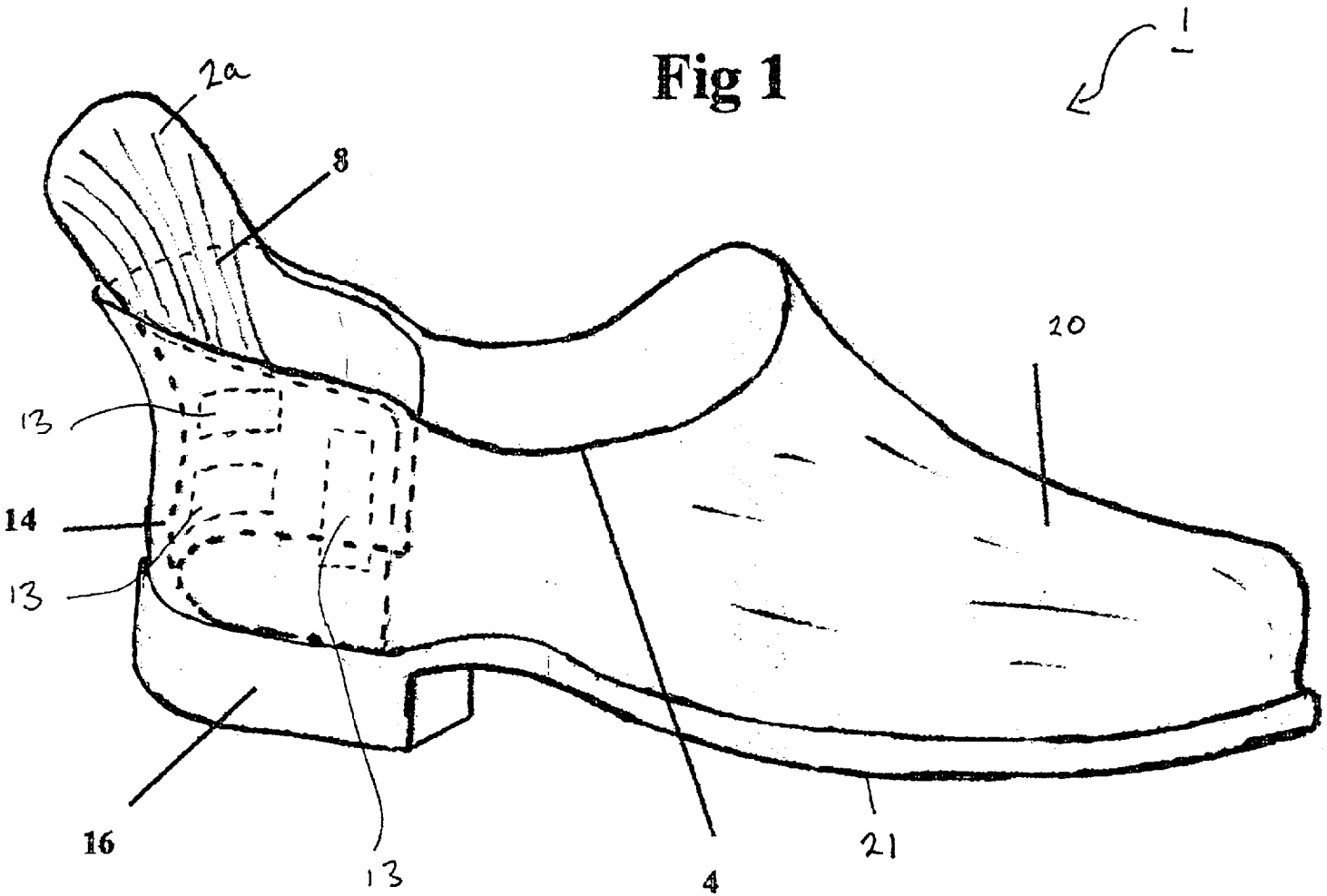
FIG. 1 is a schematic perspective view of a shoe fitted with a shoe horn attachment of the present invention.

FIG. 1 illustrates a shoe 1 fitted with a first shoe horn attachment 8 of the present invention. The shoe may be any conventional shoe having a sole denoted generally at 21 and an upper denoted generally at 20, and its construction will not be described in detail. FIG. 1 shows a slip-on shoe, but the invention may also be applied to a shoe having a fastener such as laces or buckles.

Figure 4:
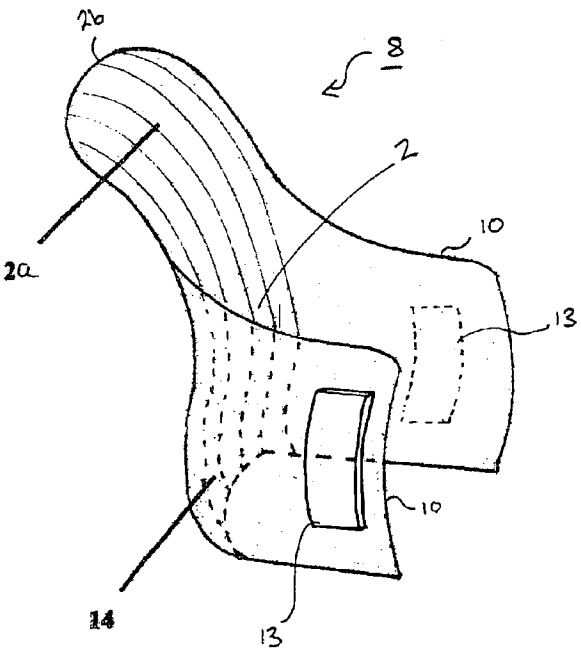
FIG. 4 is a schematic perspective view of a shoe horn attachment according to the present invention.

The shoe horn attachment is illustrated in FIG. 4. As can be seen from FIGS. 1 and 4, the shoe horn attachment 8 is intended to be inserted into the back of a shoe, and then secured to the shoe. The attachment is dimensioned so as to be a snug fit into the back of a shoe, and is shaped generally to match the contours of the rear part of a human foot. The shoe horn attachment 8 has a back 2, and left and right side portions 10. The height of the left and right side portions 10 is substantially equal to the height of the rim 4 of the upper 20 of the shoe, as shown in FIG. 1 which illustrates the shoe horn attachment 8 of FIG. 4 in use. The back portion 2 of the shoe horn attachment 8 is, however, higher than the back of the upper of the shoe so that, when the attachment 8 is located within a shoe, the upper back portion 2*a* of the attachment protrudes above the rim 4 of the shoe. In FIG. 1, the length of the sides 10 of the shoe horn attachment correspond generally with the length of the heel portion 16 of the sole of the shoe 1, but the sides 10 of the shoe horn attachment may alternatively be longer or shorter than the heel portion 16 of the sole of the shoe 1.

The side portions 10 are spaced from one another so that the overall width of the attachment is substantially equal to the interior width of the shoe. Moreover, the side portions 10 and back portion 2 of the attachment are preferably contoured so as to be a close fit into the interior of the upper of the shoe, for example the external profile of each side portion 10 is preferably substantially complementary to the internal profile of the side walls of the upper of the shoe. Moreover, the inner side of the heel of a human foot generally has a different profile from the outer side of the heel, since more weight tends to bear on the inner side of the heel. The shoe horn attachment is preferably contoured 14 to allow for this. As a consequence, a shoe horn attachment that is a good fit for a left foot will not be a good fit for a right foot shoe, and vice versa. It is therefore preferable to manufacture the attachments in pairs, one intended for a left foot and one intended for a right foot.

The heel of a lady's foot generally has a different shape to the heel of a man's foot. It is therefore preferable to manufacture differently-shaped attachments for men and ladies.

As noted above, height of the left and right side portions 10 is substantially equal to the height of the rim 4 of the upper 20 of the shoe heel. It is therefore preferable to manufacture a range of two or more attachments which have side portions of different height. A user is then able to choose the attachment which most nearly matches the height of the rim of the upper of their shoes.

Fastening means 13 are provided to attach the shoe horn attachment 8 to the shoe 1. In the embodiment of FIG. 4 the fastening means are adhesive fastening means. In one embodiment, as shown in FIG. 4, the adhesive fastening means consist of adhesive strips 13 disposed on the exterior surface of the attachment 8. When the attachment is fitted into a shoe, the adhesive strips will fasten the attachment to the upper of the shoe.

FIG. 4 shows two adhesive strips 13, one disposed on the exterior of each side portion 10 of the attachment. The invention is not limited to this precise number of adhesive strips, however, nor is it limited to providing adhesive only on the side portions of the attachment 2. For example, further adhesive strips could be disposed on the exterior of the rear portion 2 of the attachment, as indicated in FIG. 1 (which shows, in broken lines, two adhesive strips mounted substantially horizontally on the exterior of the rear portion 2 of the attachment).

Figure 4A:
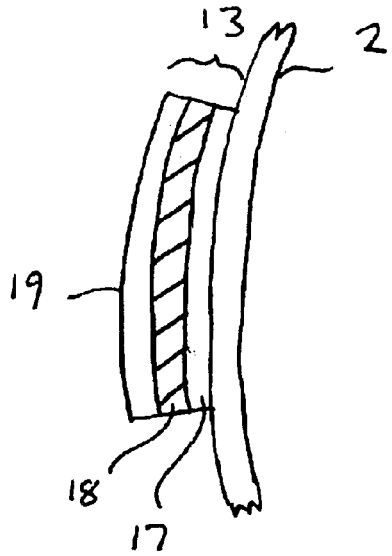
FIG. 4*a* shows an example of a suitable fastening means for fastening a shoe horn attachment of the present invention to a shoe.

The strips 13 may conveniently be self-adhesive strips. FIG. 4*a* is a schematic cross-section through one embodiment of a self-adhesive strip 13 attached to the side-portion 10 of the attachment. FIG. 4*a* shows a self-adhesive strip 13 consisting of a substrate 18 disposed between first and second adhesive layers 17, 19. The first adhesive layer 17 secures the substrate 18 to the attachment, by any suitable means such as, for example, an adhesive layer (not shown). The second adhesive layer 19 is disposed on the outer face of the substrate 18 and, when the attachment is fitted into a shoe, adheres to the upper of the shoe thereby securing the attachment in place. The fastening means of FIG. 4*a* may conveniently be formed of commercially available double-sided adhesive tape.

If it desired to make the attachment removable, the strength of the outer adhesive layer 19 may be chosen to sufficiently high to provide a secure bond to the interior of the upper of the shoe but not so high that the upper would be damaged if the adhesive layer 19 were detached from the upper to allow the attachment to be removed.

The attachment may be sold with the adhesive layers or strips 13 in place. The user then only has to place the attachment into a shoe, and to fasten the attachment in place by pressing the attachment against the upper of the shoe to cause the adhesive strips to adhere to the upper of the shoe.

The adhesive layers or strips may initially be covered by a backing paper (not shown), to prevent degradation of the adhesive layer before the shoe horn attachment was installed into a shoe. When a user wishes to insert the shoe horn attachment into a shoe, they remove the backing paper, insert the attachment into the shoe, and press the attachment against the upper of the shoe so that the adhesive layers adhere to the interior of the shoe.

The invention is not limited to the use of adhesive fastening means and, in principle, any suitable means could be used to fasten the shoe horn attachment 8 to a shoe.

Figure 2:
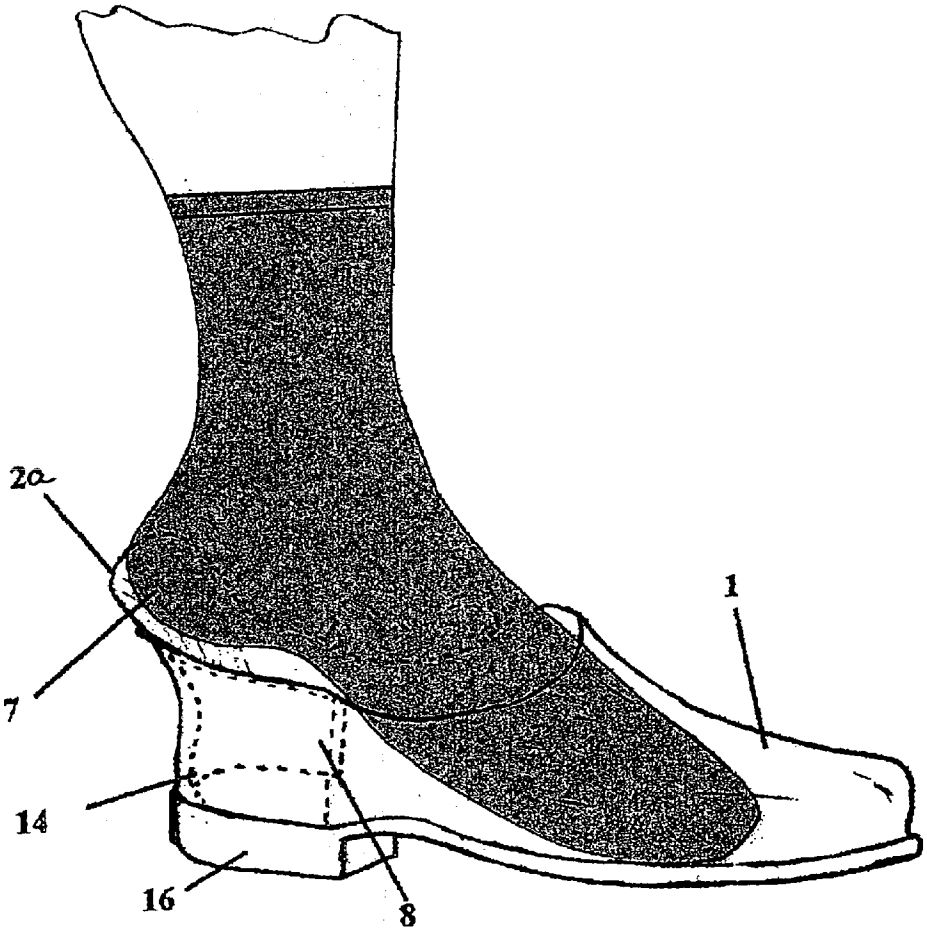
FIG. 2 is a schematic view of a user inserting a foot into the shoe of FIG. 1.

The upper portion 2*a* of the back portion 2 of the shoe horn attachment 8 is shaped in the manner of a conventional shoe horn and serves to guide the user's foot into the shoe. A user is therefore not required to bend down in order to put the shoe on. Furthermore, when a user inserts their foot into the shoe, the shoe horn attachment 8 protects the upper of the shoe from distortion, since the user's foot comes into contact with the shoe horn attachment 8, in particular the upper portion 2*a* of the back of the shoe horn attachment, rather than with the upper of the shoe. This is illustrated in FIG. 2, which shows a user in the act of putting a shoe 1 on. It can be seen that the heel 7 of the user's foot makes contact with the upper portion 2*a* of the shoe horn attachment 8. The shaping of the upper part 2*a* of the back of the attachment 8 means that the pressure exerted by the heel of the user's foot will cause the back part of the upper of the shoe to flex backwards slightly, making it easy for the user to insert their foot into the shoe and to clip their foot into the shoe horn attachment. Once the user's foot is in place in the shoe the user's foot will no longer exert pressure on the upper part 2*a* of the attachment so that the shoe will revert to its original shape and so grip the user's foot securely. Furthermore, as noted above, the user's heel 7 does not come into contact with the upper of the shoe 1, so that distortion and damage of the upper are prevented.

Figure 4B:
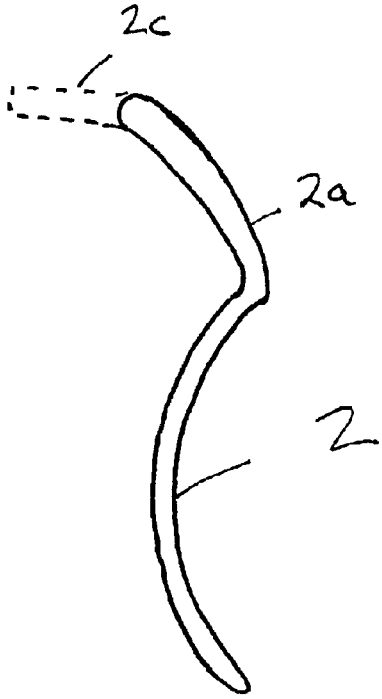
FIG. 4*b* is a schematic cross-section of the shoe horn attachment of FIG. 4.

FIG. 4*b* is a cross-section of the attachment of FIG. 4. It will be seen that the lower part of the back 2 of the attachment is contoured to fit the heel of the user's foot, and so has a concave profile. When the user's foot is fully inserted into the shoe, their heel clips into the attachment.

Figure 3:
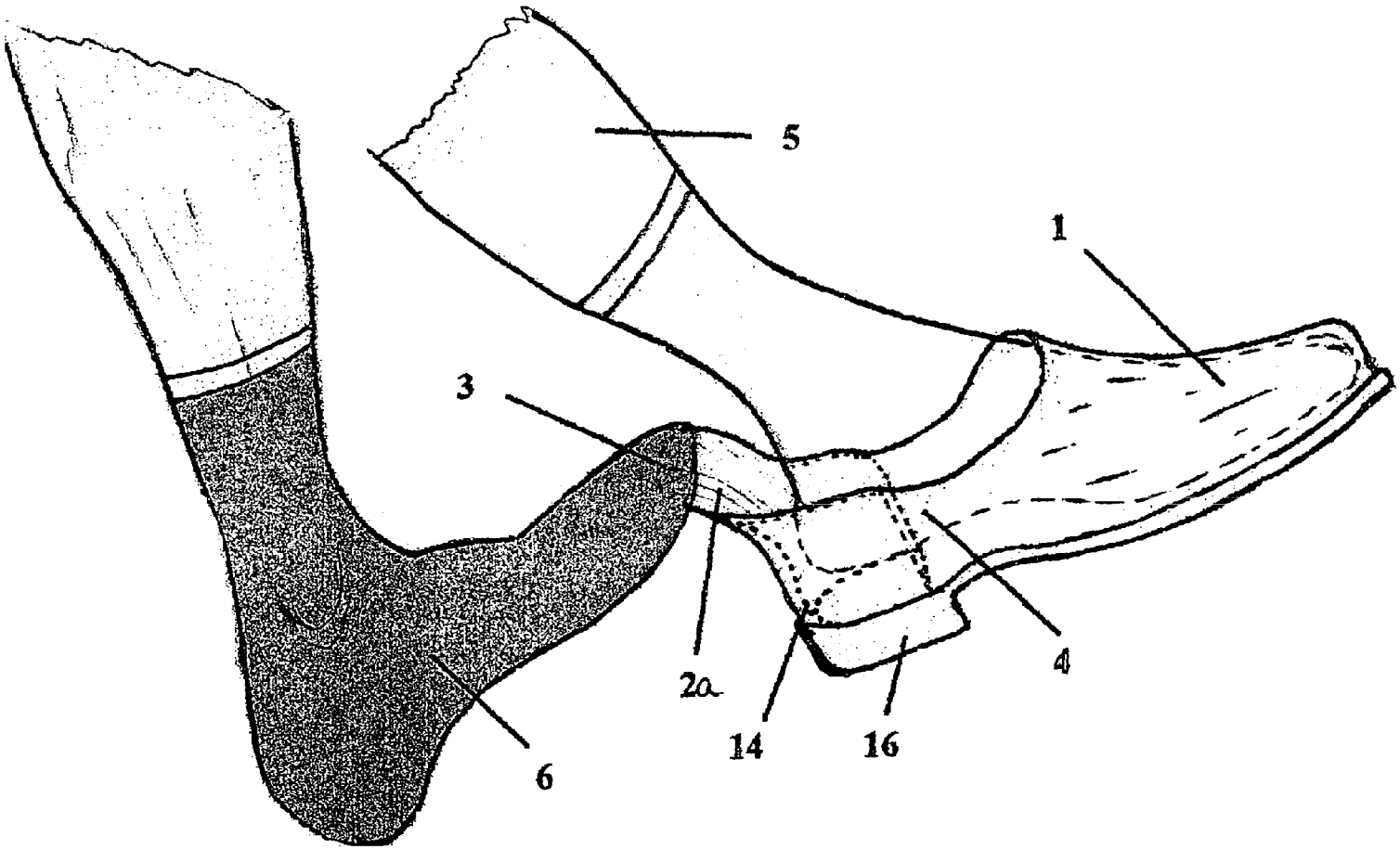
FIG. 3 is a schematic view of a user taking off the shoe of FIG. 3.

A shoe horn attachment 8 of the present invention also makes it easier for a user to take the shoe off. The process of removing a shoe is illustrated in FIG. 3. As can be seen, the user may move a shoe 1 from one leg 5 by placing the toes 3 of their other foot 6 against the top of the back portion 2*a* of the heel attachment 8. When the user then withdraws their leg 5 from the shoe, the pressure exerted by their other foot 6 on the shoe horn attachment 8 will prevent the shoe from moving as the user withdraws their leg. The user is thus easily able to remove the shoe, without the need to bend down. Furthermore, in order to remove a conventional slip-on shoe without bending down it is necessary for a user to place their other foot against the heel of the shoe to prevent it moving, and this is liable to damage the upper of the shoe. With the present invention, however, the user's other foot 6 does not make contact with the upper of the shoe, but only with the heel attachment. There is therefore no risk of damage to the upper of the shoe.

As an alternative to placing their other foot against the attachment 8 as shown in FIG. 3, the user could place the upper part 2*a* of the shoe horn attachment against any suitable object such as, for example, a cross brace of a chair or other item of furniture, or a crutch or walking stick.

To facilitate removing the shoe, the shoe horn attachment may be provided with a portion 2*c* that projects rearwardly from the top portion 2*a* of the back of the attachment. This is shown in broken lines in FIG. 4*b*. The projecting portion 2*c* increases the surface area of the attachment, so that it is easier for user to keep the attachment in contact with an object while they are taking the shoe off.

The shoe horn attachment is preferably made of a flexible, resilient material, so that the back portion 2 and the side portions 10 can flex to accommodate the user's ankle during the process of putting the shoe on, while still maintaining vertical strength in order to support the back part of the upper 20 of the shoe. The attachment may conveniently be moulded from a plastics material. Any plastics material that is sufficiently strong and that can be moulded easily can be used. One suitable material is PVC. Where a hard plastics material is used to form the attachment 8, it has been found that a thickness of approximately 1 mm provides sufficient strength for the lower back portion 2 and the side portions 10 of the attachment.

During the process of putting or taking off a shoe considerable forces may be exerted on the upper part 2*a* of the back of the attachment. The upper part 2*a* of the back of the attachment may therefore need to have a greater thickness than the back portion and the side portions 10, in order to provide it with sufficient strength. Making the upper part 2*a* of the back relatively thick thicker has the further advantage in that the upper edge 2*b* of the attachment may be given a rounded profile thereby eliminating sharp edges that could be uncomfortable to the user.

Figure 5:
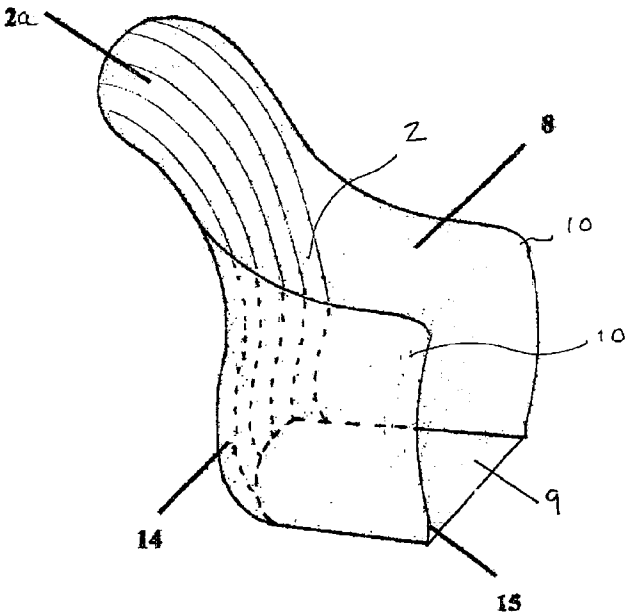
FIG. 5 is a schematic perspective view of another shoe horn attachment according to the present invention.

FIG. 5 shows an alternative embodiment of a shoe horn attachment of the present invention. This generally corresponds to the attachment shown in FIG. 4, except that the attachment of FIG. 5 additionally has a base portion 9. In contrast, the base of the attachment shown in FIG. 4 is open (so that a user's heel will rest on the inner sole of the shoe).

The attachment of FIG. 5 may again be secured to a shoe by any convenient way. If the attachment is fastened to a shoe using adhesive, it would be possible to dispose adhesive on the underside of the base portion 9, as well as on the external faces of the side portions 10 and the lower rear portion 2.

Figure 6:
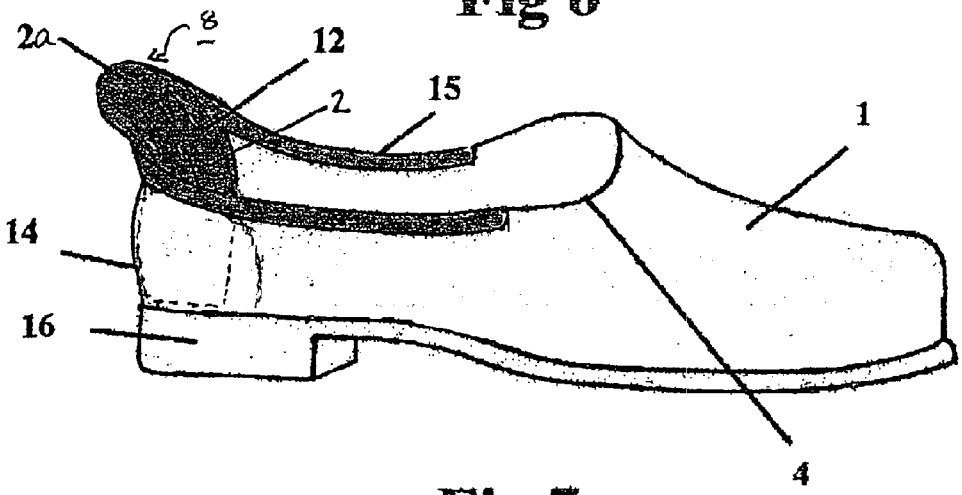
FIG. 6 is a schematic perspective view of a shoe fitted with an alternative shoe horn attachment of the present invention.

FIG. 6 shows a shoe fitted with a shoe horn attachment 8 according to a further embodiment of the invention. The attachment 8 of FIG. 6 corresponds generally to that of FIG. 4, except that the side portions 10 of the insert 8 of FIG. 4 are replaced by retaining members 15 that are intended to fit over the top rim 4 of the shoe. The members 15 have a cross section that generally corresponds to an inverted "V", and fit over the top rim 4 of the shoe. The attachment 8 may again be fastened to the shoe in any suitable way. For example if the attachment is moulded in a suitable plastics material it is possible to crimp the retaining members over the top rim of the upper of the shoe and thereby fasten the attachment to the shoe. Alternatively it is possible to dispose adhesive on the exterior of the back portion 2 of the insert and/or under the members 15.

Figure 7:
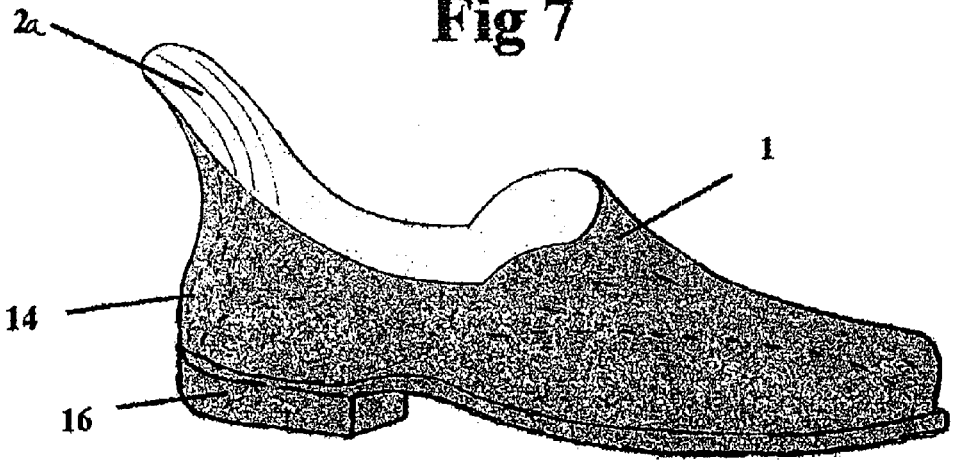
FIG. 7 is a schematic perspective view of a shoe having an integral guiding means.

FIG. 7 shows a shoe in which the back portion of the upper of the shoe is extended into a shoe horn-shaped portion 2*a*. In this shoe, the shoe horn portion 2*a* is an integral part of the upper of the shoe. The shoe can be made from any suitable materials.

Figure 8:
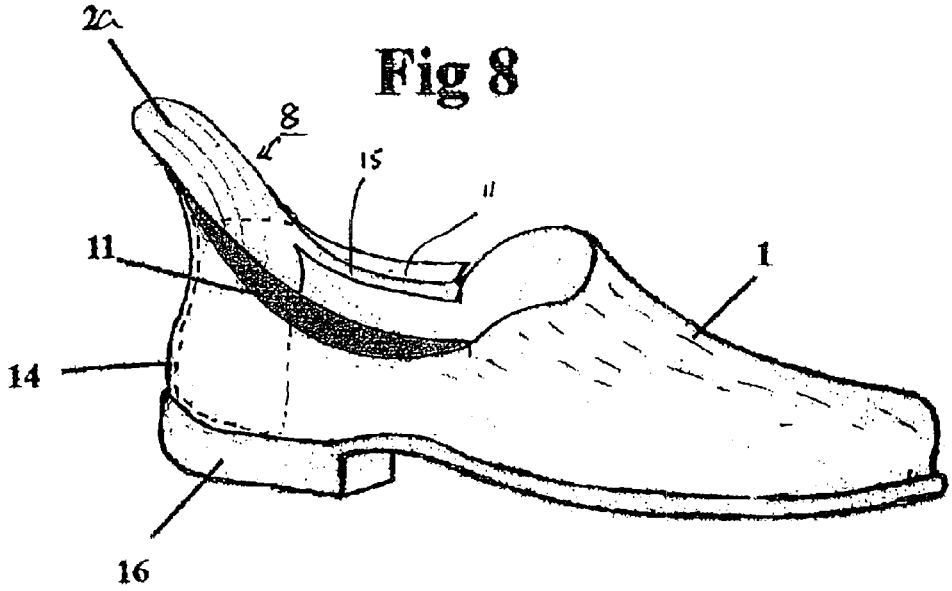
FIG. 8 is a schematic perspective view of a shoe fitted with another shoe horn attachment of the present invention.

FIG. 8 shows a shoe fitted with a shoe horn attachment 8 according to a further embodiment of the invention. The shoe horn attachment 8 of FIG. 8 corresponds generally to that shown in FIG. 6, except that it further comprises wings 11 that are attached to the shoe horn retaining members 15. These may be used for decorative purposes, for example for a child's shoe. However, the wings are angled outwards, and so provide some protection for the user's ankle.

As has been explained above, one use of a shoe horn attachment of the present invention is to allow a person who has become disabled to modify their existing shoes so that they can put their shoes on, and take their shoes off, without the need to bend down. It is, of course, quite possible that a person who becomes disabled will have lace-up shoes, and so would want to fit a shoe horn attachment of the present invention to lace-up shoes as well as to slip-on shoes. In principle, it is quite possible to provide a lace-up shoe with a shoe horn attachment of the present invention, and this would make it possible to put the shoe on, and take the shoe off, without the need for the user to bend down.

One problem with applying the present invention to a lace-up shoe is that the tongue of the shoe may curl back as the foot is pressed forward into the shoe, so that the tongue would not end up in its correct position. This could be uncomfortable for the user, and could also cause damage to the tongue. This problem is likely to arise only with lace-up shoes, since in a slip-on shoe the tongue is stitched well back from the toe down the sides of the shoe and tongue so that the tongue is unlikely to distort as the foot is pressed into the shoe. The extent to which the tongue is likely to curl up when the invention is applied to a lace-up shoe will depend on the strength of the material from which the tongue is made.

To overcome the problem of the tongue curling up, it is possible to provide the tongue with additional support. In the case of the tongue of a lace-up shoe, the user would initially put the shoe on, and tie the laces up after adjusting the laces to give a comfortable fit of the shoe. The user can then remove the shoe, and then fasten the tongue of the shoe to the upper of the shoe. The tongue will then be held in a suitable position, and will not be able to curl up when the user next puts the shoe on.

One convenient way of attaching the tongue to the underside of the upper of the shoe is by use of an adhesive. For example, one or more pieces of double-sided adhesive tape may be disposed between the upper face of the tongue and the underside of the upper of the shoe. The adhesive tape will support the tongue and hold it in place, and so will prevent the tongue from rolling back as the user's foot is forced forwards and down into the shoe.

A shoe horn insert of the present invention thus enables the person to adapt their existing shoes to slip-on shoes that can be put on or taken off without the need for the user to bend down. A user who becomes disabled is therefore not required to buy special shoes of the type disclosed in UK Patent Application No. 9018750.1. Furthermore, if a user is temporarily disabled—for example, following an accident— upon recovery the user can, if they desire, remove the shoe horn attachment from their shoes without damage to their shoes.

A further use of the present invention is in "wearing in" a new pair of shoes. Wearing a new pair of shoes is sometimes uncomfortable, since the back of the shoe may be stiff and rub against the user's heel. This can be prevented by fitting a new pair of shoes with shoe horn attachments of the present invention for an initial period after the shoes have been purchased. Once the shoes have been worn for a while and have adapted to the shape and size of the user's foot the attachments may be removed if desired.

What is claimed is:

1. A shoe horn attachment device comprising:

a contoured portion structured and arranged to surround a heel of a user's foot and comprising a back portion and left and right side portions;

a flexible resilient upper back portion extending obliquely from the back portion substantially outside of a rim of a shoe of a user when the attachment device is attached to the shoe of the user, said upper back portion being flexibly displaceable to guide a heel of the user when a foot of the user is being inserted into the shoe; and a fastening device on at least one of the back, left and right portions for readily detachably securing the attachment device to the shoe of the user.

2. The device as claimed in claim 1, further comprising a base portion connected between the left and right portions, essentially parallel to a heel of the shoe of the user when the attachment device is attached to a shoe of the user.

3. The device as claimed in claim 1, further comprising an essentially inverted V-shaped retaining member fitting over the rim of the shoe of the user.

4. The device as claimed in claim 3, further comprising a wing member extending laterally from the retaining member.

5. The device as claimed in claim 1, wherein the fastening device is double sided tape.

6. The device as claimed in claim 1, wherein the fastening device is adhesive.

7. The device as claimed in claim 1, further comprising a rearward projecting portion extending from said upper back portion.

8. A shoe horn attachment device comprising:

a contoured portion structured and arranged to surround a heel of a user comprising a back portion and left and right side portions;

a base portion between the left and right portions, essentially parallel to a heel of a shoe of the user when the device is attached to a shoe of the user; and an upper back portion extending from the back portion substantially outside of a rim of the shoe of the user when the attachment is attached to the shoe of the user, said upper back portion being flexibly displaceable to guide a heel of the user when a foot of the user is being inserted into the shoe, said device being readily removable such that when a foot of a user is in the shoe, the device remains in place and when the foot of the user is removed from the shoe, the device is readily removable.

9. The device as claimed in claim 8, further comprising a fastening device on at least one of the back, left and right portions for detachably securing the attachment to the shoe of the user.

10. The device as claimed in claim 9, further comprising a fastening device on the base portion.

11. The device as claimed in claim 8, wherein the fastening device is double sided tape.

12. The device as claimed in claim 8, wherein the fastening device is adhesive.

* * * * *